United States Patent [19]

Bornell

[11] 4,288,930

[45] Sep. 15, 1981

[54] REMOVEABLE TAPS

[76] Inventor: Donald G. Bornell, 860 Riven Rock Rd., Santa Barbara, Calif. 93108

[21] Appl. No.: 109,971

[22] Filed: Jan. 7, 1980

[51] Int. Cl.[3] ..... A43B 5/12

[52] U.S. Cl. ..... 36/132; 36/139

[58] Field of Search ..... 36/113, 135, 132, 139; 273/DIG. 18; 2/DIG. 6; 24/DIG. 18; 428/7

[56] References Cited

U.S. PATENT DOCUMENTS

| | | | |
|---|---|---|---|
| 1,152,115 | 8/1915 | McCormick | 36/113 X |
| 1,962,948 | 6/1934 | Banker | 36/7.5 X |
| 2,113,477 | 4/1938 | Gilman | 36/113 X |
| 2,671,971 | 3/1954 | Garretson | 36/113 X |
| 2,723,467 | 11/1955 | Cassidy | 36/113 X |
| 3,204,348 | 9/1965 | Latson | 36/113 X |
| 3,913,243 | 10/1975 | Arnold et al. | 36/135 |
| 4,055,005 | 10/1977 | Meinhart | 2/DIG. 6 |

*Primary Examiner*—Henry F. Epstein

*Attorney, Agent, or Firm*—Harry W. Brelsford

[57] ABSTRACT

A tap is strapped to the toe of ordinary street shoes for amateur type tap dancing and slipped over the fingers of those confined to wheelchairs for hand tapping. A thin body of hard material has spaced slots thru which a strap is passed which is fastened over the top of the toe of the shoe. The tap body is thinned on one surface between the slots and is thinned outboard of the slots on the other side to accomodate the thickness of the strap. The strap is preferably elastic and coated with a tacky material on the shoe side to retain it in place on the toe of the shoe.

2 Claims, 9 Drawing Figures

REMOVEABLE TAPS

My invention relates to taps for attaching to shoes for tap dancing. More particularly it relates to taps that are readily strapped to, and unstrapped from shoes and which may be conveniently strapped also to hands for keeping rhythm with the hands.

BACKGROUND OF THE INVENTION

Various designs have been made of taps that are removeable from shoes so that ordinary street shoes can be used for tap dancing. Various hooks, nails, straps and elastic grippers have been devised but none of these have been successful enough to be placed upon the market. The principal tap dancing is, therefore, done with special shoes that sell for $30.00 and upwards. This is a great deterrent to youngsters desiring to try out tap dancing to determine if they wish to take instruction.

SUMMARY OF THE INVENTION

I have devised a pair of taps and an elastic strap design that permits the taps to be quickly attached to the toes of shoes. The structure is simple and inexpensive and allows young people to try tap dancing without an expenditure for special shoes.

Further, the design is inexpensive and accommodates a large number of different shapes of shoes and different shapes of toes of shoes. I make my tap of hard metal, preferably light weight aluminum or magnesium and generally in the shape of the toe outline of a shoe. It is slotted to receive a pass-thru strap. The inside surface is concave to accommodate the thickness of the strap while the outer edges of the tap engage the shoe sole. The outer part of the tap is thinned outboard of the slots to accommodate the strap thickness so the strap will not touch the floor and so that metal will be in contact with the floor upon which the tap is used. I coat the inside of the strap with a sticky material so that the strap will better engage the shoe and maintain its position on the shoe. Any quick fastener may be used for the strap and it is fastened over the top of the toe of the shoe. While buckles and buttons could be used I presently prefer hook and pile fasteners or their equivalents, mushroomed topped flexible plastic stems that interengage when located on opposite ends of the strap. These straps fasteners are adjustable and the straps are preferably elastic and therefore can be fitted over the fingers of the hands for finger tapping in rhythm.

DETAILED DESCRIPTION

Various objects, advantages and features of the inventon will be apparent in the following description and claims considered together with the accompanying drawings forming an integral part of this specification and in which:

Figure 1:
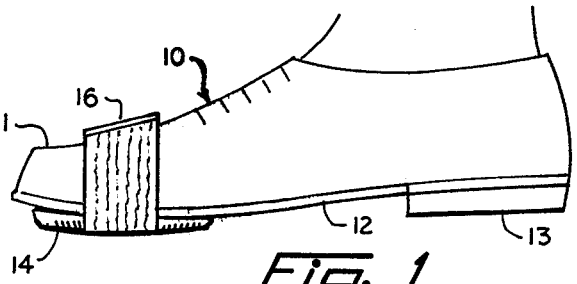
FIG. 1 is an elevation view of a shoe having a tap secured thereto in accordance with the invention.
Figure 2:
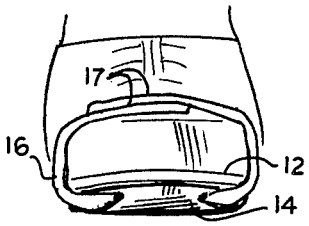
FIG. 2 is a front view of the shoe of FIG. 1.

Referring to FIGS. 1 and 2 a pair of shoes 10 has a toe 11, a sole 12 and a heel 13. Disposed on the toe portion of the sole 12 is a tap 14 constructed in accordance with my design and held in place by a strap 16 passing thru the top with the strap ends fastened together in overlapping fashion with any suitable fastener, such as a button and buttonhole, buckle, lacing, etc. I presently prefer hook patches secured to one end 17 engaging pile patches secured to the other end 17. Such a fastener is adjustable by overlapping the ends any desired amount, and is readily opened by pulling on the upper end 17. I presently prefer the strap to be elastic and to obtain better adhesion to the shoe toe and the sole, I coat the strap with a sticky adhesive that remains on the strap when the strap is removed from the shoe. A gummy type of latex of the type applied to the bottom of carpets has proved to be satisfactory.

Figure 3:
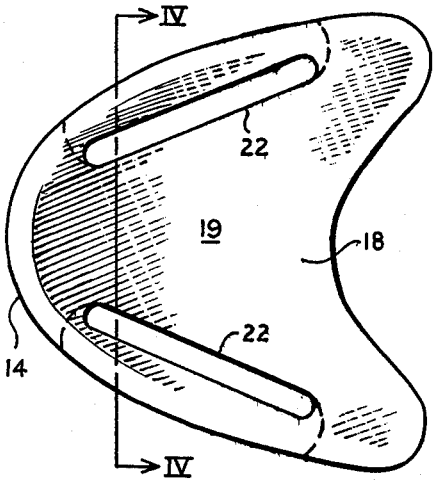
FIG. 3 is a plan view of a tap embodying my new design.
Figure 4:
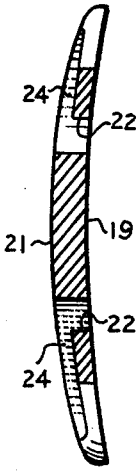
FIG. 4 is a sectional view taken along the lines IV—IV of FIG. 3.
Figure 6:
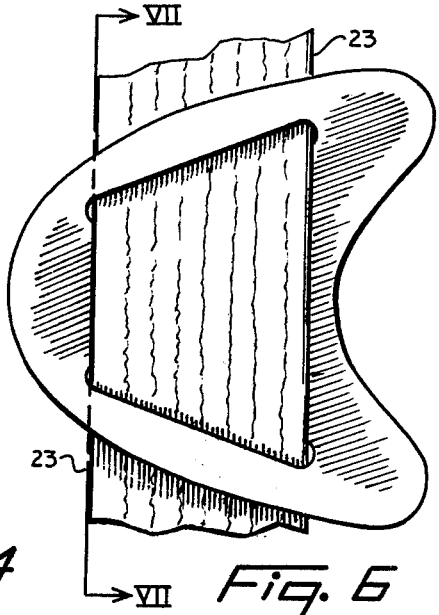
FIG. 6 is a plan view of the top of FIG. 3 with a strap passed through the slots.
Figure 5:
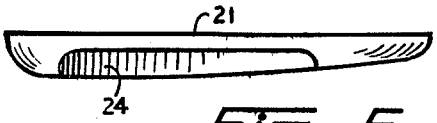
FIG. 5 is a side view of the top of FIG. 3.

Referring to FIGS. 2 through 7, the shape of the tap can follow generally shoe shapes in style at any one time and I presently prefer the U-shaped or horseshoe shaped outline shown on FIGS. 3 and 6. For those using more pointed shoes a generally triangular shape with a rounded apex can be used. The tap has a central web or body 18 inside the U-shape or triangular shape and the upper side 19 may be concave to accommodate the strap while the bottom 21 is generally flat.

Disposed toward the outer opposite edges of the tap 14 are a pair of slots 22 thru which a strap 23 is passed. The lower side of the tap 14 outboard of the slots is reduced in thickness by an amount greater than the thickness of the strap and these two reduced areas form cutouts 24 shown best in FIG. 4. The inner side 19 of the tap 14 is sufficiently concave so that the area between the slots 22 is recessed enough to accommodate the thickness of the strap 23, as best shown in FIG. 7.

Figure 7:
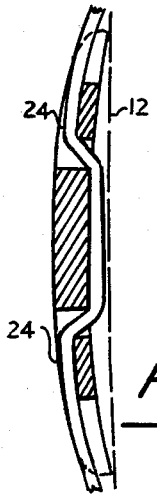
FIG. 7 is a sectional view along the line VII—VII of FIG. 6.

Shown in FIGS. 6 and 7 is the manner of passing the strap thru the tap in undulating fashion. The strap will not touch the dance floor when the taps are in place on the shoe because of the cutouts 24 as shown best in FIG. 7.

Figure 8:
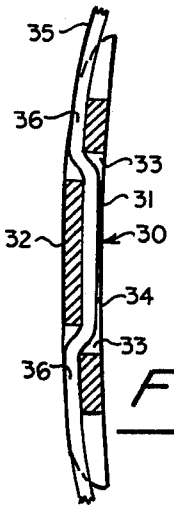
FIG. 8 is a sectional view of a modified form of the invention showing a flat upperside of the tap with a trough for the strap.

Shown in FIG. 8 is a modified tap 30 having an inner side 31 that is flat as well as an outer surface 32 that is flat. A pair of slots 33 are formed in the same general locations as the slots 22 of FIG. 3, and between the slots 33 of FIG. 8 there is formed a trough 34 in which is disposed a strap 35. Outboard of the slots 33 the tap 30 is thinned to form cutouts 36 to accommodate the strap 35.

Figure 9:
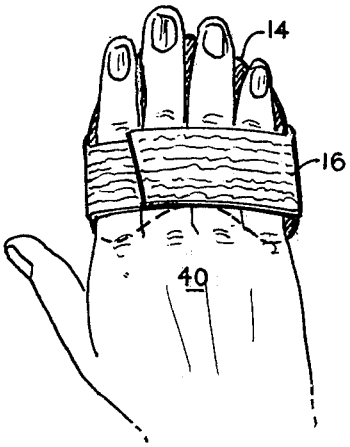
FIG. 9 is a plan view of the top of FIG. 1 as applied to the hand of a user for finger tapping.

Illustrated in FIG. 9 is the tap 14 of FIGS. 3 through 7 as applied to a hand 40 for finger tapping. This has particular utility for children in wheel chairs who cannot tap with their feet.

I have found that children readily use the taps on their regular street shoes of all types whether gym shoes, running shoes or conventional shoes. The taps stay in place with even the most energetic dancing and are very satisfactory for tap dancing on an amateur level.

I have described my invention with respect to a presently preferred embodiment as required by the statutes. The form described is merely illustrative of my invention and is not limiting as various modifications will occur to those skilled in the art. Accordingly, there is included within the scope of the following claims all variations, modifications and improvements that come within the true spirit and scope of the invention.

I claim:

1. A removeable tap for shoes having a sole and toe for tap dancing on a floor comprising:

(a) a tap body having an inner side and an outer side and having an outline generally in the shape of a shoe toe with a solid web inside the outline and having a pair of slots on opposite sides of the body, the inner side of the tap body being thinned between the slots and the outer side being thinned outboard of the slots to accommodate the thickness of the strap as it is passed through one slot across the inside of the tap body to the other slot so that the hard tap body will be in contact with the floor and sole of the shoe;

(b) a strap having a thickness passing through the slots and having ends that overlap over the top of the shoes;

(c) and press-together pull-apart fastener patches on adjacent surfaces of the strap ends to achieve adjustment as well as fastening of the strap over the toe of the shoe.

2. The combination of claim 1 wherein the side of the strap adjacent to the shoes is coated with a sticky material to help the strap stay in place at the toe of the shoe.

* * * * *